US005119867A

United States Patent [19]

Lukos

[11] Patent Number: 5,119,867

[45] Date of Patent: Jun. 9, 1992

[54] ARM STRUCTURE FOR AWNING SUPPORT SYSTEM

[76] Inventor: Stephen P. Lukos, 1879 Litchfield Rd., Watertown, Conn. 06795

[21] Appl. No.: 673,189

[22] Filed: Mar. 21, 1991

[51] Int. Cl.[5] ..... E04F 10/06

[52] U.S. Cl. ..... 160/70; 160/79

[58] Field of Search ..... 160/66, 67, 69, 70, 160/78, 79, 22; 135/89; 248/611, 273

[56] References Cited

U.S. PATENT DOCUMENTS

| | | | |
|---|---|---|---|
| 1,021,330 | 3/1912 | Price | 160/78 X |
| 1,759,715 | 5/1930 | Schane | 160/70 |
| 1,796,419 | 3/1931 | Anton | 248/273 |
| 1,842,402 | 1/1932 | Heiser | 160/70 |
| 1,856,161 | 5/1932 | Heiser | 160/70 |
| 1,897,029 | 2/1933 | Bell et al. | 160/70 |
| 1,915,529 | 6/1933 | Heiser | 160/70 |
| 2,321,801 | 6/1943 | Dazzo | 160/69 |
| 4,214,621 | 7/1980 | Wessels et al. | 160/66 |
| 4,495,977 | 1/1985 | Delluc | 160/66 X |

FOREIGN PATENT DOCUMENTS

| | | | |
|---|---|---|---|
| 3625604 | 2/1988 | Fed. Rep. of Germany | 160/67 |
| 483001 | 4/1938 | United Kingdom | 160/70 |

*Primary Examiner*—David M. Purol

*Attorney, Agent, or Firm*—Evelyn M. Sommer

[57] ABSTRACT

An awning support structure has lateral arms with shoulder ends which are pivotably mounted to load-adjusting mounting members secured to a mounting portion of a building. The load-adjusting mounting members allow the lateral arms to deflect in the upward or downward directions, in order to allow the awning structure to absorb and/or shed the load. The preferred mounting members have urethane compression joints securing the shoulder ends of the lateral arms to shoulder brackets fixed to a support tube which is secured to the building.

5 Claims, 2 Drawing Sheets

ARM STRUCTURE FOR AWNING SUPPORT SYSTEM

FIELD OF THE INVENTION

This invention generally relates to an awning support system, and more particularly, to one having improved lateral arm structure for supporting an awning canopy.

BACKGROUND ART

Awning support systems generally have sets of lateral arms which are mounted at one end by brackets to the wall or frame of a building and are joined at the opposite end to one or more cross ribs so as to create a support for stretching and holding an awning cover thereon. Some awning systems have lateral arms which can be collapsed downward when the awning is to be taken down, such as shown in U.S. Pat. No. 4,648,573, or arms which retract in an accordion-like manner, as shown in U.S. Pat. No. 4,641,805. In U.S. Pat. No. 4,673,017, an awning support system is shown having a bracket structure which allows the lateral arms to be adjustably set to different angular positions. However, in all such awning support systems, the lateral arms are rigidly held in a fixed position during the time the awning is in use. This rigidity has the problem that serious damage can occur to the arm structure if an excessive load is placed on the awning, such as from excessive weight of snow, water, or wind thereon, or if a vandal grabs onto the end of the awning.

Accordingly, it is a principal object of the invention to provide an awning support system which has means for preventing damage to the arm structures when the awning is subjected to excessive loads.

SUMMARY OF THE INVENTION

In accordance with the invention, the lateral support arms of an awning structure have ends which are mounted to a building on spring-loaded pivot brackets. The support arm ends are compressibly held between a pair of opposed springs. If a potentially damaging load is applied on the awning, such as snow or water or a wind load in either direction (up or down), the compression springs will deflect, in order to allow the awning structure to absorb and/or shed the load. When the excessive load is removed, the compression springs will return the lateral arms of the awning to their equilibrium position.

Other objects, features, and advantages of the present invention will become apparent from the following detailed description of the best mode of practicing the invention when considered in conjunction with the drawings, as follows:

DESCRIPTION OF THE PREFERRED EMBODIMENTS

Figure 1A:
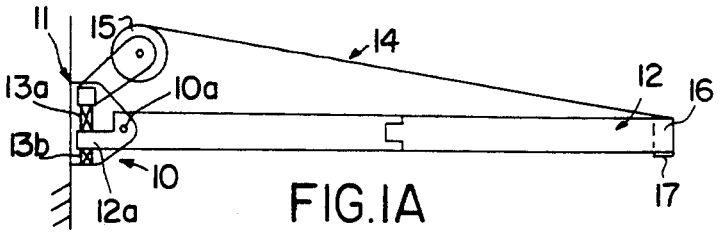
FIGS. 1A, 1B, and 1C are schematic side views of an awning support system having lateral arms mounted to spring-loaded pivot brackets in accordance with the invention.
Figure 1B:
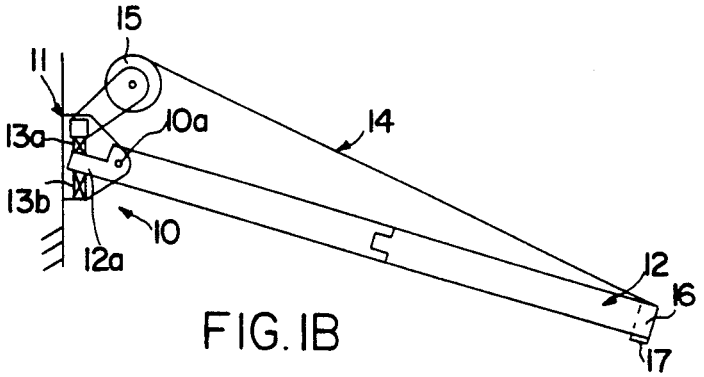
Figure 1C:
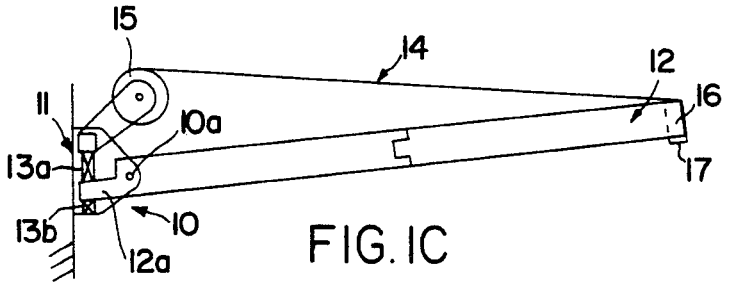
Figure 2:
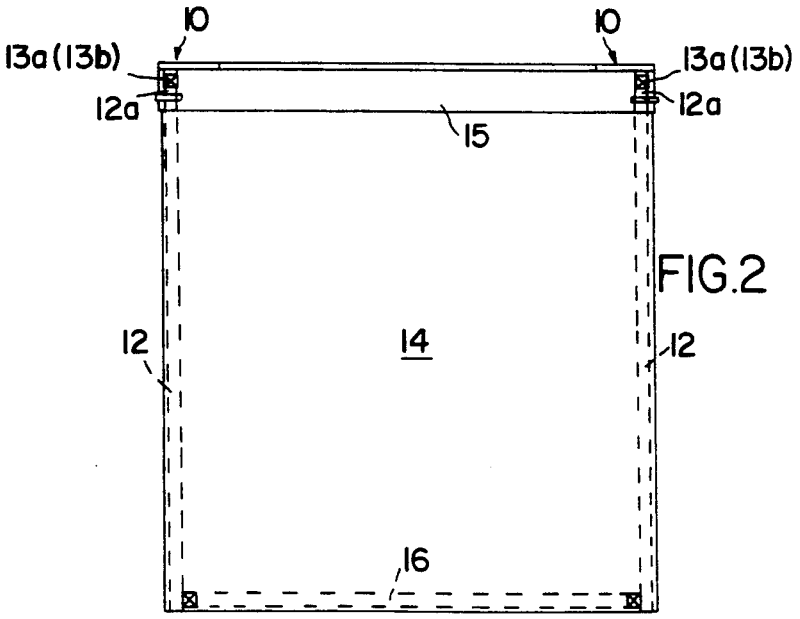
FIG. 2 shows a plan view of the awning support system in FIG. 1.

Referring to FIGS. 1A, 1B, 1C, and 2, an awning support system has mounting brackets 10 secured, such as by screws or anchor bolts, to a wall 11 of a building, and lateral support arms 12 having ends 12*a* which are pivotably mounted to the brackets 10 at pivot mounting points 10*a*. The support arm ends 12*a* are compressibly held between a pair of compression springs 13*a*, 13*b* which are pre-selected and tensioned so as to hold the lateral arms 12 in an extended equilibrium position under normal loading conditions.

The springs can be compression or extension coil type, urethane, leaf, torsion, or pneumatic type, or any combination thereof. The lateral arms can be of any desired construction, such as straight tubing, telescoping tubing, downwardly folding or retractable type. The tubing construction of the lateral arms can be designed to accomodate stress also, such as by providing flexiblity, lighter weight members at the ends of the arms, and/or interior dampers. An awning cover 14 made of a weatherproof fabric is wound on a reel 15 rotatably mounted to the brackets 10. The leading end of the awning cover is stretched over a front rail 16 joined to the other ends of the lateral arms 12. Typically, the leading end of the cover is stapled in a stapling groove formed in the front rail 16, and a sealing strip 17 is press-fitted into the stapling groove to hold the cover therein and seal the groove.

Figure 3:
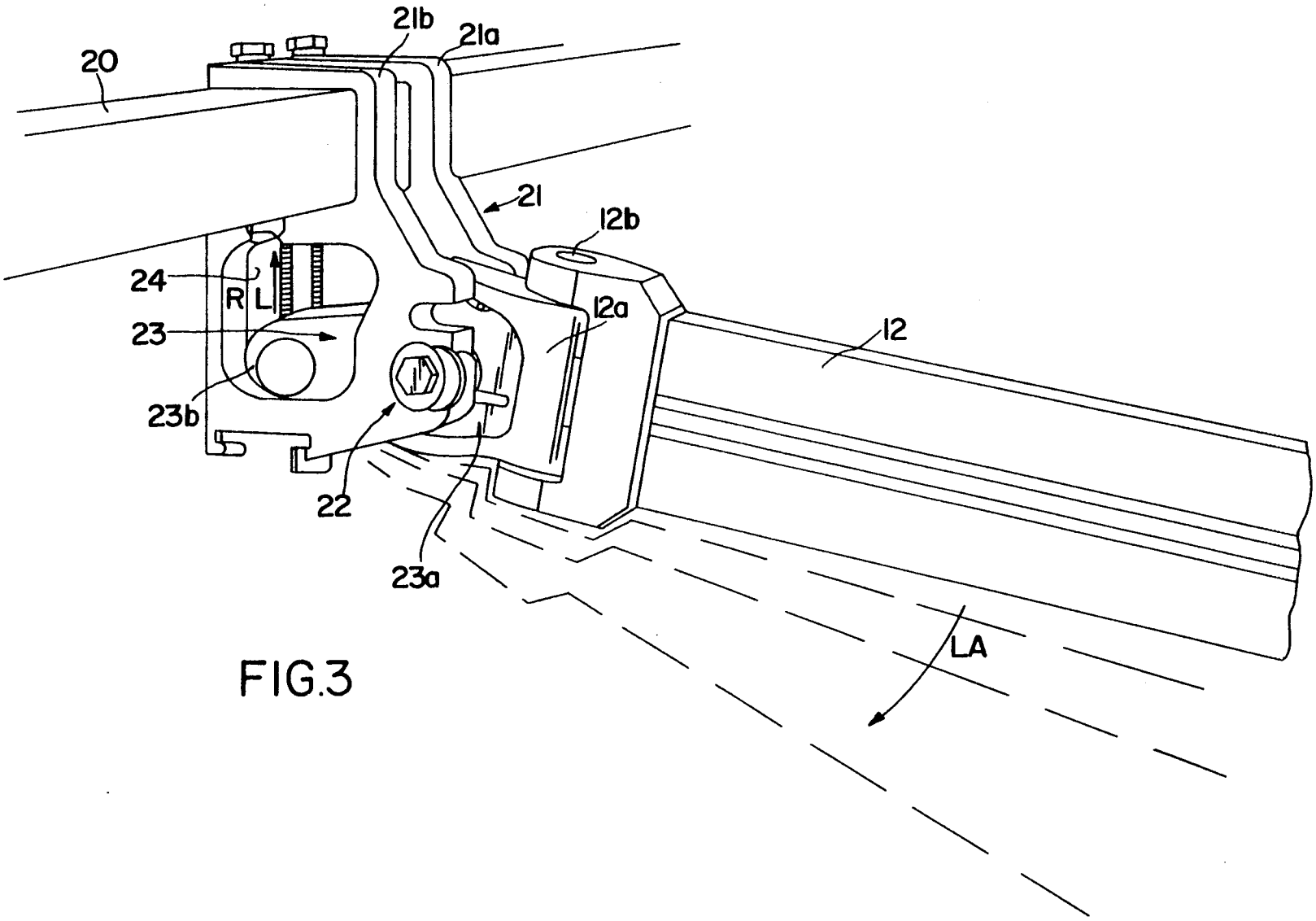
FIG. 3 shows a preferred embodiment of the awning support system having lateral arms mounted via adjustment shoulders having urethane compression joints.

In FIG. 3, an awning support system is shown having lateral arms mounted via adjustment shoulders using urethane type compression joints, which are the most preferred implementation of the load-shedding mounting of the invention. The mounting includes a support tube 20 which is secured to the building wall, a shoulder bracket 21 which is clamped or otherwise fixed to the support tube 20, the lateral arm 12 being mounted to the shoulder bracket 21 via a pivot pin 22, and a compression member 23 made of high density polyurethane having a main body portion 23*a* interposed between a clamp end 12*a* of the arm 12 and the pivot pin 22 and a load-adjusting tail portion 23*b* which abuts in a recess 24 formed in the walls of the shoulder bracket 21. The shoulder bracket 21 has a pair of parallel bracket portions 21*a*, 21*b* which are spaced apart by a gap forming the recess 24. The tail portion 23*b* of the compression member 23 is compressed between the bracket portions 21*a*, 21*b* and is frictionally slidable along the recess 24 so as to accommodate and shed an excess load applied to the lateral arm 12. The shoulder end of the lateral arm 12 is shown in FIG. 3 as having the clamp end 12*a*, by which it is secured to the main body portion 23*a* of the compression member 23. An excess load is transmitted through the clamp end 12*a* to the main body portion 23*a* pivoted about pin 22 to the tail portion 23*b*. When an excessive load is applied to the lateral arm, the urethane compression joint 23 compresses allowing the load-adjusting tail portion 23*a* to shed some of the load by frictionally moving along the walls of the recess 24, in the direction of the arrow RL, whereby the lateral arm 12 is allowed to yield downwardly in the direction of the arrow LA to release some of the load. The urethane compression joints can also be installed in an elbow or shoulder of the lateral arms or in the mounting bracket shelf. The lateral arm 12 is also shown having a further pivot axis 12*b* for allowing it to fold in the transverse direction for storage.

With the load-adjusting mounting of the lateral arms, if a potentially damaging load is applied on the awning, such as snow or water or a wind load in either direction (up or down), the load-adjusting members can be deflected up (FIG. 1C) or down (FIG. 1B) in order to absorb and/or shed the load. Water or snow that pools or accumulates on the upper surface of the awning cover would be discharged as the awning is deflected downward. The force of wind on the awning would be absorbed by deflection of the lateral arms. Similarly, the awning would yield flexibly under a heavy load applied suddenly to the lateral arms, such as a vandal grabbing onto the end of the awning. When the excessive load is removed, the compressiion springs return the lateral arms of the awning to their equilibrium position. This load absorbing or shedding capability greatly reduces the likelihood that an excessive load will cause damage to the lateral arms or the awning cover or cause their mountings to pull out of the wall.

Numerous modifications and variations are of course possible in light of the principles of the invention disclosed above. All such modifications and variations are intended to be included within the spirit and scope of the invention, as defined in the following claims.

I claim:

1. An awning structure for supporting an awning from a building, comprising:

a pair of mounting members which are mounted to a mounting portion on the building in spaced relation from each other;

a pair of lateral arms each having a shoulder end pivotably mounted to a pivot mounting point on a respective one of the mounting members and a distal end adapted to extend in a direction outwardly from the building;

a front rail joined to the distal ends of said lateral arms; and an awning cover extended over said lateral arms to said front rail and having a leading end secured to said front rail, wherein said mounting members each has a spring-loaded means for deflectably holding said shoulder ends of said lateral arms, in order to allow the awning structure to absorb and/or shed excessive loads applied thereon, and wherein said mounting member are shoulder brackets each of which is respectively mounted to a support tube fixed to the building and has a pivot mounting to which the shoulder end of the respective lateral arm is secured in order to allow it to deflect in a downward direction under an excessive load.

2. An awning structure according to claim 1, wherein said spring-loaded means includes a pair of compression springs in each of said mounting members for compressibly holding the shoulder end of the respective lateral arm therebetween.

3. An awning structure according to claim 1, wherein said spring-loaded means includes a load-adjusting urethane compression joint.

4. An awning structure according to claim 1, wherein said mounting members further include means defining a further pivot mounting for allowing said lateral arms to fold in a direction transverse to the downward direction for storage.

5. An awning structure for supporting an awning from a building, comprising:

a pair of mounting members which are mounted to a mounting portion on the building in spaced relation from each other;

a pair of lateral arms each having a shoulder end pivotably mounted to a pivot mounting point on a respective one of the mounting members and a distal end adapted to extend in a direction outwardly from the building;

a front rail joined to the distal ends of said lateral arms; and an awning cover extended over said lateral arms to said front rail and having a leading end secured to said front rail, wherein said mounting members each has a spring-loaded means for deflectably holding said shoulder ends of said lateral arms, in order to allow the awning structure to absorb and/or shed excessive loads applied thereon, and wherein said mounting members each has said spring-loaded means arranged at the pivot mounting points to which the shoulder ends of said lateral arms are pivotably mounted, said spring-loaded means deflectably allowing said shoulder ends of said lateral arms deflection movement, in order to allow the awning structure to absorb and/or shed excessive loads applied thereon.

* * * * *